US012421682B2

(12) United States Patent
Helliwell et al.

(10) Patent No.: US 12,421,682 B2
(45) Date of Patent: Sep. 23, 2025

(54) METHOD AND SYSTEM OF UNDERGROUND DEPLOYMENT OF MATERIALS AND EQUIPMENT

(71) Applicant: hyperTunnel IP Limited, Basingstoke (GB)

(72) Inventors: James Helliwell, Basingstoke (GB); Alan Meeks, Basingstoke (GB); Steve Jordan, Basingstoke (GB)

(73) Assignee: HyperTunnel IP Limited, Basingstoke (GB)

( * ) Notice: Subject to any disclaimer, the term of this patent is extended or adjusted under 35 U.S.C. 154(b) by 183 days.

(21) Appl. No.: 18/119,051

(22) Filed: Mar. 8, 2023

(65) Prior Publication Data

US 2023/0220646 A1 Jul. 13, 2023

Related U.S. Application Data

(63) Continuation of application No. PCT/IB2021/058250, filed on Sep. 10, 2021.

(30) Foreign Application Priority Data

Sep. 21, 2020 (GB) ..... 2014837

(51) Int. Cl.
*E02F 3/06* (2006.01)
*E02D 3/12* (2006.01)
(Continued)

(52) U.S. Cl.
CPC ..... *E02D 3/12* (2013.01); *E02D 5/46* (2013.01); *E02D 37/00* (2013.01); *E21D 9/001* (2013.01)

(58) Field of Classification Search
CPC .. E02D 3/12; E02D 5/46; E02D 37/00; E21D 9/001; E21B 7/046; E21B 7/065;
(Continued)

(56) References Cited

U.S. PATENT DOCUMENTS 2,304,793 A * 12/1942 Bodine, Jr. ..... E21B 29/00 30/106
3,508,317 A * 4/1970 Hill ..... E21D 11/40 29/819
(Continued)

FOREIGN PATENT DOCUMENTS

CN 107119669 9/2017
CN 108060908 5/2018
(Continued)

OTHER PUBLICATIONS

Danish Patent and Trademark Office, First Technical Examination in corresponding application PA202370158, Jan. 22, 2024.
(Continued)

*Primary Examiner* — Edwin J Toledo-Duran
(74) *Attorney, Agent, or Firm* — Alley IP

(57) ABSTRACT

Jet grouting involves injecting grout into geological material to improve its quality; however, use of jet grouting is limited to situations in which the injection systems can be positioned relatively close to the region to be improved. This can be impractical (for example in heavily built up areas, rough terrain or beneath the seabed) or inconvenient (for example where closing a tunnel would be required). The present invention enables deployment equipment 41 to be passed down a bore in order to deploy material and/or equipment through a hole in the lining of a bore 43 into the underlying geology. In this way, underground assets may be repaired from a location external to the asset, allowing repair in situations where it would be impossible or cost-prohibitive to do so with conventional ground treatment techniques.

2 Claims, 4 Drawing Sheets

(51) Int. Cl.
*E02D 5/46* (2006.01)
*E02D 37/00* (2006.01)
*E21D 9/00* (2006.01)

(58) Field of Classification Search
CPC ..... F16L 55/179; F16L 55/265; E03F 3/06; E03F 2003/065; Y10T 29/49831
See application file for complete search history.

(56) References Cited

U.S. PATENT DOCUMENTS

| | | | | |
|---|---|---|---|---|
| 3,967,463 | A * | 7/1976 | Grandori | E21D 9/093 299/33 |
| 3,972,200 | A * | 8/1976 | Scarpi | E21D 11/406 405/141 |
| 4,442,891 | A * | 4/1984 | Wood | F16L 55/179 409/143 |
| 4,454,655 | A * | 6/1984 | Ellis | G01B 5/02 33/544.2 |
| 4,724,108 | A * | 2/1988 | Jurgenlohmann | F16L 55/179 264/31 |
| 5,005,911 | A * | 4/1991 | Fikse | E21D 9/1093 299/56 |
| 6,008,657 | A * | 12/1999 | Suyama | G01N 22/02 324/528 |
| 6,142,187 | A * | 11/2000 | Goldenberg | F16L 55/28 138/97 |
| 6,167,968 | B1 | 1/2001 | Allarie et al. | |
| 7,823,463 | B1 * | 11/2010 | Feller | G01F 1/667 73/861.27 |
| 9,869,420 | B2 * | 1/2018 | Penza | F16L 55/265 |
| 10,502,035 | B2 | 12/2019 | Sandkleiva | |
| 2004/0261998 | A1 * | 12/2004 | Lavaure | E21B 33/138 166/380 |
| 2006/0042835 | A1 | 3/2006 | Guerrero et al. | |
| 2006/0289074 | A1 * | 12/2006 | Eriksson | B23K 26/262 138/171 |
| 2010/0148566 | A1 * | 6/2010 | Home | E21D 20/003 299/31 |
| 2010/0284748 | A1 * | 11/2010 | Graham | E21D 19/04 405/146 |
| 2012/0018147 | A1 * | 1/2012 | Niconoff | E21B 49/10 166/250.01 |
| 2015/0204042 | A1 | 7/2015 | Collis | |
| 2016/0131287 | A1 * | 5/2016 | Cloos | F16L 13/141 285/337 |
| 2016/0341340 | A1 * | 11/2016 | Gomes Fernandes | F16L 7/00 |
| 2017/0234115 | A1 | 8/2017 | Sandkleiva | |
| 2019/0353027 | A1 * | 11/2019 | Stack | E21B 17/1042 |
| 2021/0247582 | A1 * | 8/2021 | Najman | G02B 6/508 |

FOREIGN PATENT DOCUMENTS

| | | |
|---|---|---|
| JP | 2004027757 | 1/2004 |
| JP | 2005-139863 | 6/2005 |
| JP | 2012-036921 | 2/2012 |
| JP | 2015132589 | 7/2015 |
| KR | 2005-0079973 | 8/2005 |
| KR | 102079673 | 2/2020 |
| WO | 00/68515 | 11/2000 |

OTHER PUBLICATIONS

Eurasiian Patent Organization, Office Action in corresponding application P102060708, Oct. 16, 2023.
UKIPO, Combined Search and Examination Report in corresponding application GB2212995.1, Oct. 5, 2022.
UKIPO, Search and Examination Report in corresponding UK application GB2014837.5, Jan. 7, 2021.
UKIPO, Examination Report in corresponding UK application GB2014837.5, Jan. 30, 2023.
WIPO, International Preliminary Report on Patentability, Dec. 1, 2022.

* cited by examiner

METHOD AND SYSTEM OF UNDERGROUND DEPLOYMENT OF MATERIALS AND EQUIPMENT

RELATED APPLICATIONS

This application claims the benefit under 35 U.S.C. § 120, and is a continuation, of co-pending International Application PCT/IB2021/058250, filed Sep. 10, 2021 and designating the US, which claims priority to GB Application 2014837.5, filed Sep. 21, 2020, such GB Application also being claimed priority to under 35 U.S.C. § 119. These GB and International applications are incorporated by reference herein in their entireties.

FIELD

The present invention relates generally to a method and system of underground deployment of materials and equipment and finds particular, although not exclusive, utility in stabilising geological material adjacent to structures and underground assets.

BACKGROUND

Pressure grouting and jet grouting are known techniques in which grout is injected into geological material (for example soil, sand and/or rock) to improve its quality, for instance to correct faults, improve its strength and/or reduce water flow through it. Such grouting techniques are often used around the foundations of large structures (buildings, bridges, etc.) and around underground structures including large pipes and tunnels. Typically, in pressure grouting, grout is injected into geological material to fill any interconnected pores and voids, in order to stabilise it without disturbing the existing material. In contrast, jet grouting is typically achieved with a relatively high velocity jet of grout, which is used to erode and significantly mix up geological materials in-situ, and often to form specific shapes (e.g. columns and/or platforms).

However, use of jet grouting is limited to situations in which the injection systems can be positioned relatively close to the region to be improved. This can be impractical (for example in heavily built up areas, rough terrain or beneath the seabed) or inconvenient (for example where closing a tunnel would be required).

SUMMARY

According to a first aspect of the present invention, there is provided a method of underground deployment, the method comprising the steps of: drilling an underground bore through underlying geology; lining the bore with a pipe; passing deployment equipment down the pipe to a predetermined location; and deploying material and/or equipment through a hole in the pipe into the underlying geology.

In this way, underground assets may be repaired from a location external to the asset, allowing repair in situations where it would be impossible or cost-prohibitive to do so with conventional ground treatment techniques. In particular, plumes of grouting compound may be injected such that an interlocking stabilised structure is formed around an asset, such that sufficient stability is achieved for subsequent operations.

In addition, equipment such as monitoring devices may be deployed adjacent to an asset, again, where it would be impossible or cost-prohibitive to do so with conventional ground treatment techniques.

Underground may mean any sub-terranean location. The surrounding geology may mean geological material adjacent to the predetermined location, and may be within the underlying geology.

Deployment may mean moving something into position, and may comprise deployment of material and/or equipment. Deployment may comprise injection.

Materials may comprise grout and/or remedial substances, such as epoxy resin, polyurethane foam, polyurethane resins, acrylic resins, cementitious grouts and aqueous solutions. The grout may be a cementitious, resinous, or solution chemical mixture.

Deployment may comprise treating, which may comprise stabilising the underlying geology. In this way, in cases where the material outside the region is relatively weak, contains voids, is unstable, or waterlogged, the material can be stabilised. Equipment may be placed down-bore to stabilise the underlying geology outside the pipe.

Deployment may comprise deployment of material and/or equipment. Deployment may comprise injection of materials.

Materials may comprise grout and/or remedial substances. The grout may be a cementitious, resinous, or solution chemical mixture. Remedial substances may comprise epoxy resin, polyurethane foam, polyurethane resins, acrylic resins, cementitious grouts and aqueous solutions.

Stabilisation may be via ground freezing techniques, for instance by coolant pumped through the hole in the pipe. Freezing techniques may be temporary. Permanent stabilisation may be achieved by injecting chemical stabiliser, for instance via chemical delivery nozzles (e.g. within telescopic arms). The amount and type of stabiliser used will be determined by the geology to be stabilised and can be controlled as required, and may comprise cement or any other suitable material such as microcements, mineral grouts (known as colloidal silica), water sensitive polyurethanes (rapid reacting foaming resin to combat water ingress), quick reacting and non-water sensitive polyurea silicate systems (expanding foam for void filling), acrylic resins, jet grouting viz. the in situ construction of solidified ground to a designed characteristic; often known as Soilcrete®, etc.

Stabilisation of the underlying geology may greatly reduce, if not completely prevent, further water ingress.

Drilling an underground bore through underlying geology may comprise using a Directional Boring technique as used in the mining, oil and gas, and construction industries. For example, Horizontal Directional Drilling (HDD) is used for installing pipes, etc. HDD is capable of boring suitably accurate bores up to ~800 m long with diameters only between 100 mm and 1200 mm. Alternatively, directional drilling is used in the oil & gas industry, and enables much longer bores to be bored.

The pipe may comprise a liner for lining the bore. In this way, the integrity of the bore may be protected. Lining may comprise lining the whole bore, or only a portion of the bore. The liner may comprise a solid wall.

The hole may comprise a single hole or a plurality of holes. The hole(s) may comprise any form of opening, such as a circular through-hole, a slot, etc.

The method may further comprise the steps of: passing equipment (e.g. drilling equipment, or some other form of equipment for making a hole) down the bore to the predetermined location along the predetermined path; and/or using the equipment to make the hole(s) at least partially through the pipe at the predetermined location(s). The hole(s) may be made by drilling, piercing, milling, punching, gouging, cutting, and/or any other suitable method.

In this way, a way for the material/equipment to be deployed through the pipe is enabled.

The equipment may comprise a carriage upon which is mounted a drill or some other form of device for making the hole(s). The drill/device may be retractable (e.g. telescopically, longitudinally and/or pivotally). The device may for example comprise a milling head that indexes around that may be configured to create a single or a variety of shapes of opening in the pipe.

The method may further comprise the step of: using the equipment to make the hole at most only partially through the pipe at the predetermined location.

In this way, external material and/or water may be prevented from entering the bore in an uncontrolled manner. In particular, the holes may extend almost all the way through the pipe wall (e.g. to less than 2 mm, in particular less than 1 mm from the outer surface of the pipe wall).

In alternative arrangements, the drill/device may be configured to make the hole entirely through the pipe, and may even be configured to drill, etc. into the surrounding geology.

The pipe may include the holes prior to insertion into the bore.

For example, the pipe may be pre-perforated. In this way, time and cost on site may be avoided in situations in which the underlying geology is well understood. The pre-perforated liner may comprise an outer sleeve that covers the perforations; in this way, external material and/or water may be prevented from entering the bore in an uncontrolled manner.

Deploying material and/or equipment through the hole may comprise extending a probe through the hole such that it passes outside the pipe. In some cases, the probe may project into the surrounding geology.

The probe may be configured to punch through the pipe wall; in particular, the probe may be configured to punch through either the small amount of pipe wall remaining after drilling etc., or the sleeve of a pre-perforated pipe.

The probe may comprise a needle. The needle may be configured to permit material flow therethrough. Alternatively, the needle may be configured to retract and a material may be injected directly through the hole.

The pipe and/or liner may comprise a plastics material, as is well understood in the art.

Various equipment (including the drilling equipment and/or the deployment equipment) may be passed through the pipe in a conventional manner to perform operations at any desired location. For example, carriages may be provided upon which specific equipment may be mounted, and/or may form part thereof. A train of carriages may be provided such that different pieces of equipment may be passed down a pipe to a predetermined location as a single train. For example, a single train may have a first carriage configured to determine location along the pipe, a second carriage configured to drill through the pipe, and a third carriage configured to inject grout through the hole. As can be appreciated, multiple pieces of equipment may be mounted on a single carriage, such that the above effects, similar effects, or different effects may be achieved with fewer (or more) carriages.

More than one carriage and/or train may be passed down a single pipe to conduct similar and/or collaborative tasks, for example at the same time at different predetermined locations along the pipe, or sequentially at different times.

Similarly, multiple carriages and/or trains may cooperate together, either by acting at the same time, or sequentially at different times, and may cooperate even in different/distinct pipes/bores, similar to any cooperation from being in the same pipe/bore. For example, if multiple bores are drilled and lined around a single asset, a respective carriage/train may be passed down each bore (e.g. to inject grout simultaneously), and/or more than one carriage/train may be passed down a single bore/pipe (e.g. to provide monitoring of an asset from more than one predetermined location along the single bore/pipe).

A carriage/train may be configured to rescue a failed carriage/train, for example by supplying power, or by attaching thereto to remove it from the bore/pipe.

For the avoidance of doubt, the predetermined location may comprise a single location or a plurality of locations.

The deployment equipment may be configured to deploy monitoring equipment outside the bore, outside the interior of the pipe, outside the exterior of the pipe and/or into the surrounding geology. This may be in addition or as an alternative to deploying material. The monitoring equipment may be configured to provide feedback (for instance back up the pipe, in a continuous manner or intermittently) on ground conditions around an asset and/or adjacent to the pipe.

The pipe installed in the ground surrounding the asset may remain intact and useable after remedial work has been carried out. The pipe can then be used for subsequent verification of results (using remote sensing technologies), through-life monitoring of the asset (by installing sensor networks within or adjacent to the workspace), used as water draining channels or filled with concrete and/or steel rebar, etc. to provide additional strength to the structure.

Data from drilling the bore can be recorded and used to inform operators as to the types of material through which they will be excavating. Thus, a more complete view of the underlying geology can be achieved.

Drilling operations may be carried out from a preconstructed tunnel entrance and/or exit, an intermediately-located shaft and/or from the surface.

The bore may comprise a hole and/or shaft that is substantially circular in cross section and has a length orders of magnitude greater than its diameter. For example, each bore may have a diameter of between 100 mm and 1200 mm; each bore may have a length of at least 25 m, at least 50 m, at least 100 m, at least 200 m or more.

The method may comprise determining the first predetermined path (and optionally the second predetermined paths); however, this is to be done by conventional methods.

The bore may have a length of at least 25 m, or less than 25 m. For example, the first bore may have a length of at least 5 m, 10 m, 15 m and/or 20 m. However, other features of the second aspect may be common with the first aspect.

According to a second aspect of the present invention, there is provided a system for carrying out the method of underground deployment according to any preceding claim, the system comprising: directional drilling apparatus for drilling an underground bore through underlying geology; a pipe for lining the bore drilled by the directional drilling apparatus; pipe lining equipment for lining the bore with the pipe; and deployment equipment configured to pass down the pipe to a predetermined location, and configured to deploy material and/or equipment through a hole in the pipe into the underlying geology.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
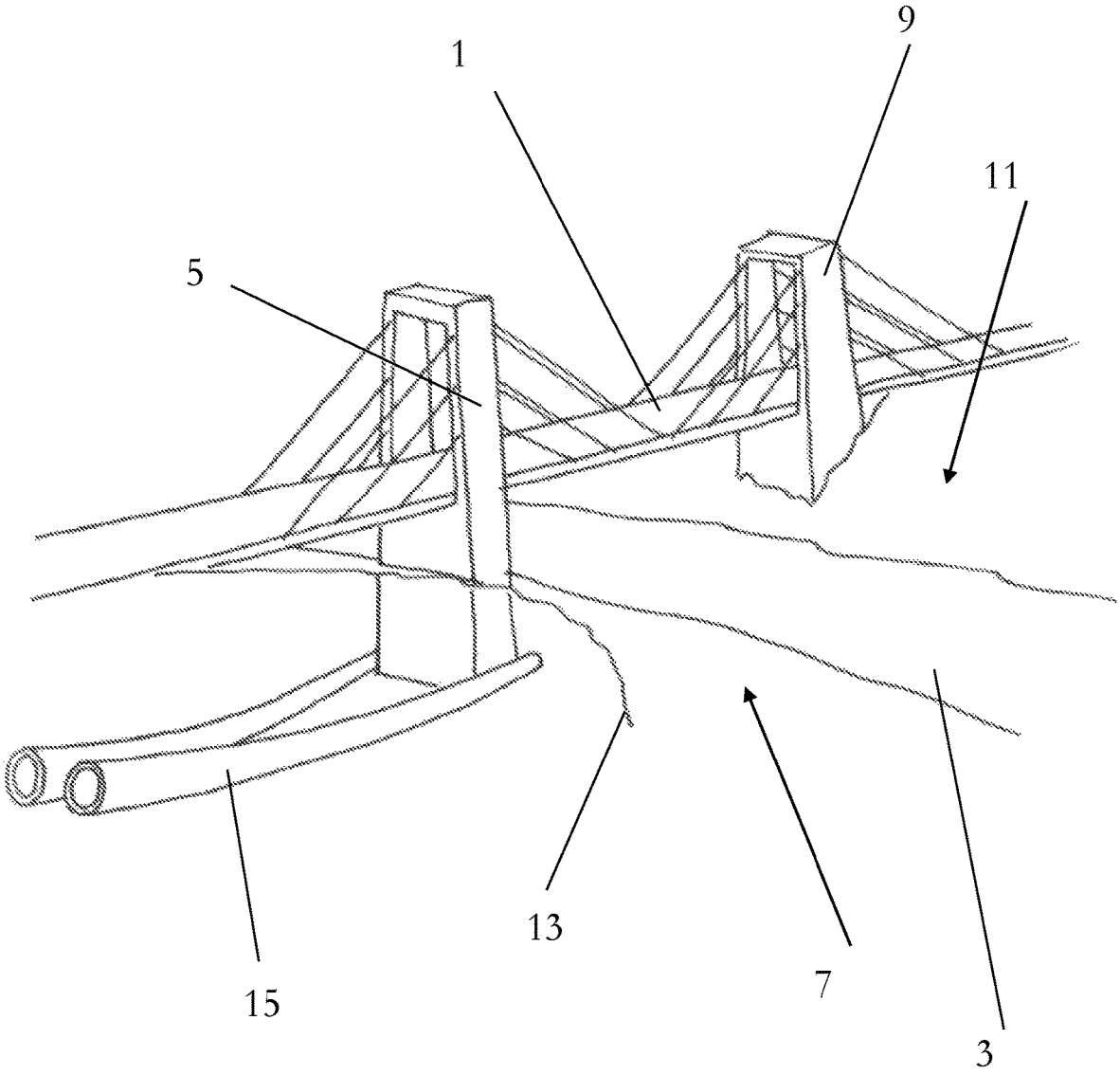
FIG. 1 is a perspective view of an environment in which a system and method of underground deployment may be employed.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein. Likewise, method steps described or claimed in a particular sequence may be understood to operate in a different sequence.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any one embodiment or aspect of the invention may be combined in any suitable manner with any other particular feature, structure or characteristic of another embodiment or aspect of the invention, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

FIG. 1 is a perspective view of a bridge 1 crossing a river 3. The bridge 1 has a first stanchion 5 on a first bank 7 and a second stanchion 9 on a second bank 11 on the opposite side of the river 3. The first bank 7 is partially cut away at the line 13 to show the bottom of the first stanchion 5 underground.

Two pipes 15 are shown within directionally-drilled bores (not shown), extending from the surface and terminating adjacent to the first stanchion 5.

Deployment equipment (not shown) may be passed down each pipe 15 until it is adjacent to the first stanchion 5, and then used to deploy material and/or equipment. This avoids the need to excavate adjacent to the first stanchion 5, which could cause problems such as subsidence and/or water penetration.

Figure 2:
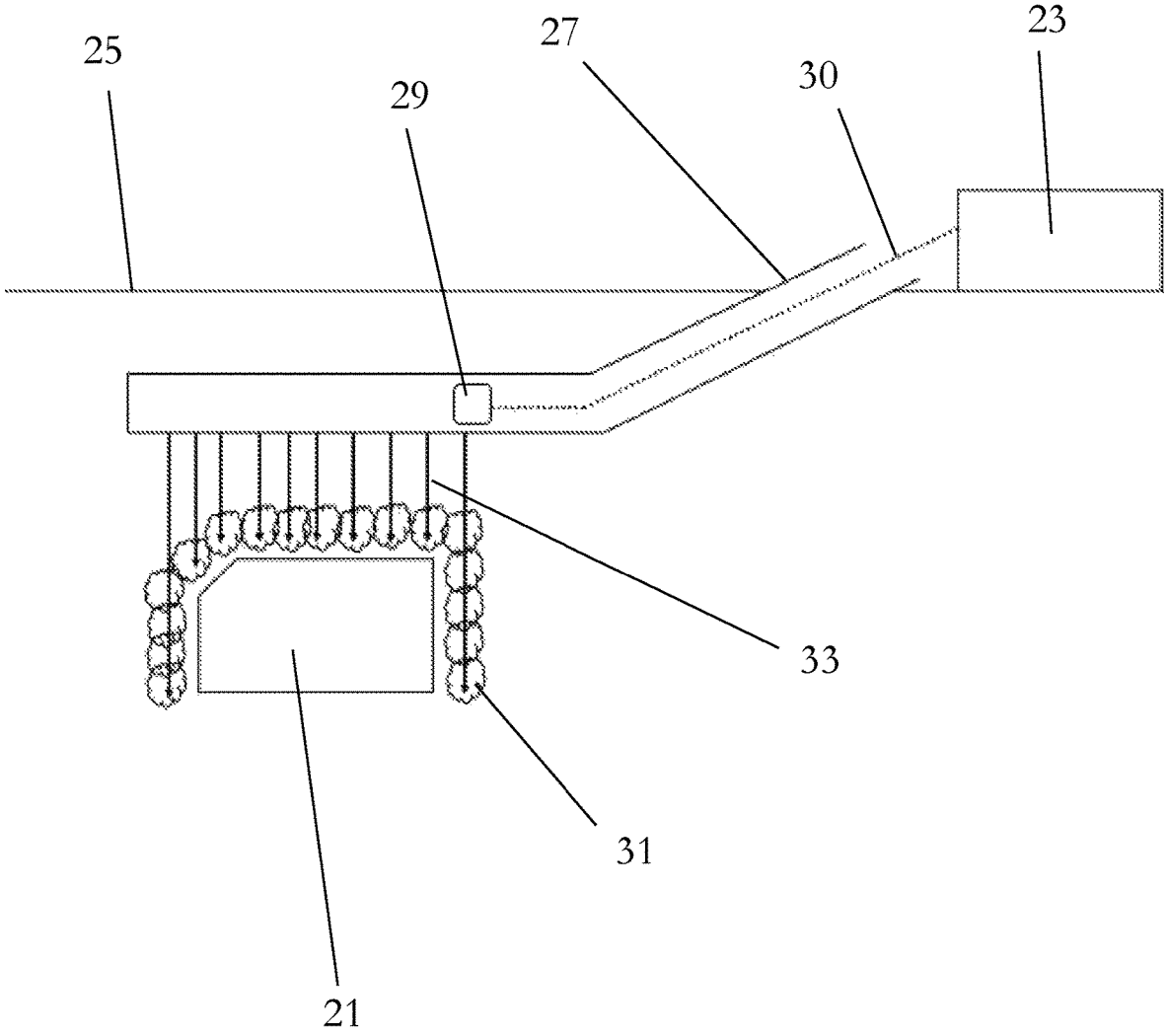
FIG. 2 is a schematic view of a system of underground deployment being used adjacent to an underground asset.

FIG. 2 shows an underground asset 21 in relation to a facility 23 on the surface 25. A bore 27 has been formed by directional drilling from the facility 23 to adjacent to the asset 21. The bore 27 has been lined, but this is not shown for clarity.

A deployment device 29 is located within the bore 27 is controlled by the surface facility 23 via means 30. The deployment device 29 is configured to move along the bore 27. The figure shows seventeen locations in which material has been deployed 31 adjacent to the asset 21. Also shown are the paths 33 of the material at the seventeen locations from the deployment devices ten separate locations within the bore 27.

Figure 3:
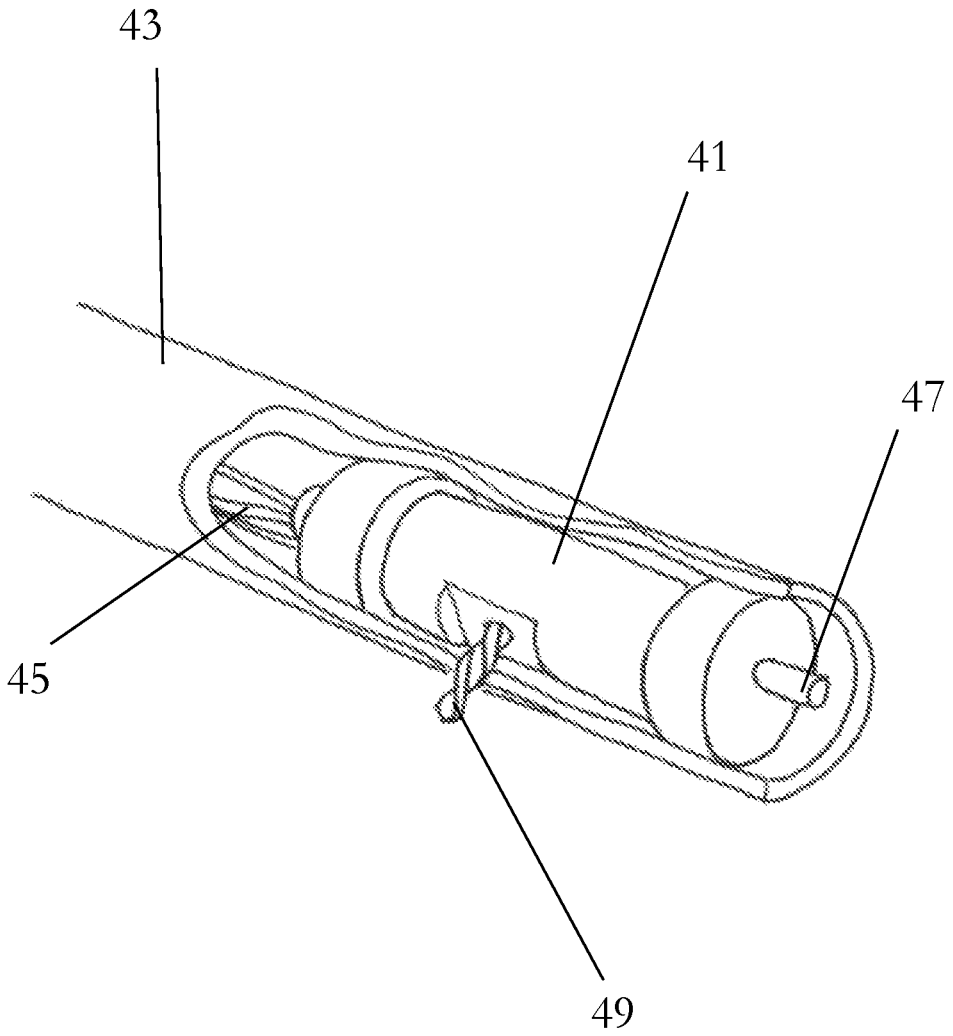
FIG. 3 is a partially cutaway perspective view of a piece of equipment located down-bore in a lining pipe.

FIG. 3 is a partially cutaway perspective view of a piece of drilling equipment 41 located down-bore in a lining pipe 43. The drilling equipment 41 has connections at an up-bore end 45 and a down-bore end 47, and comprises a drill bit 49 that is shown extending through the pipe wall 43. The drill bit 49 is retractable withing the casing of the drilling equipment to enable the drilling equipment to pass through the lining pipe 43.

Figure 4:
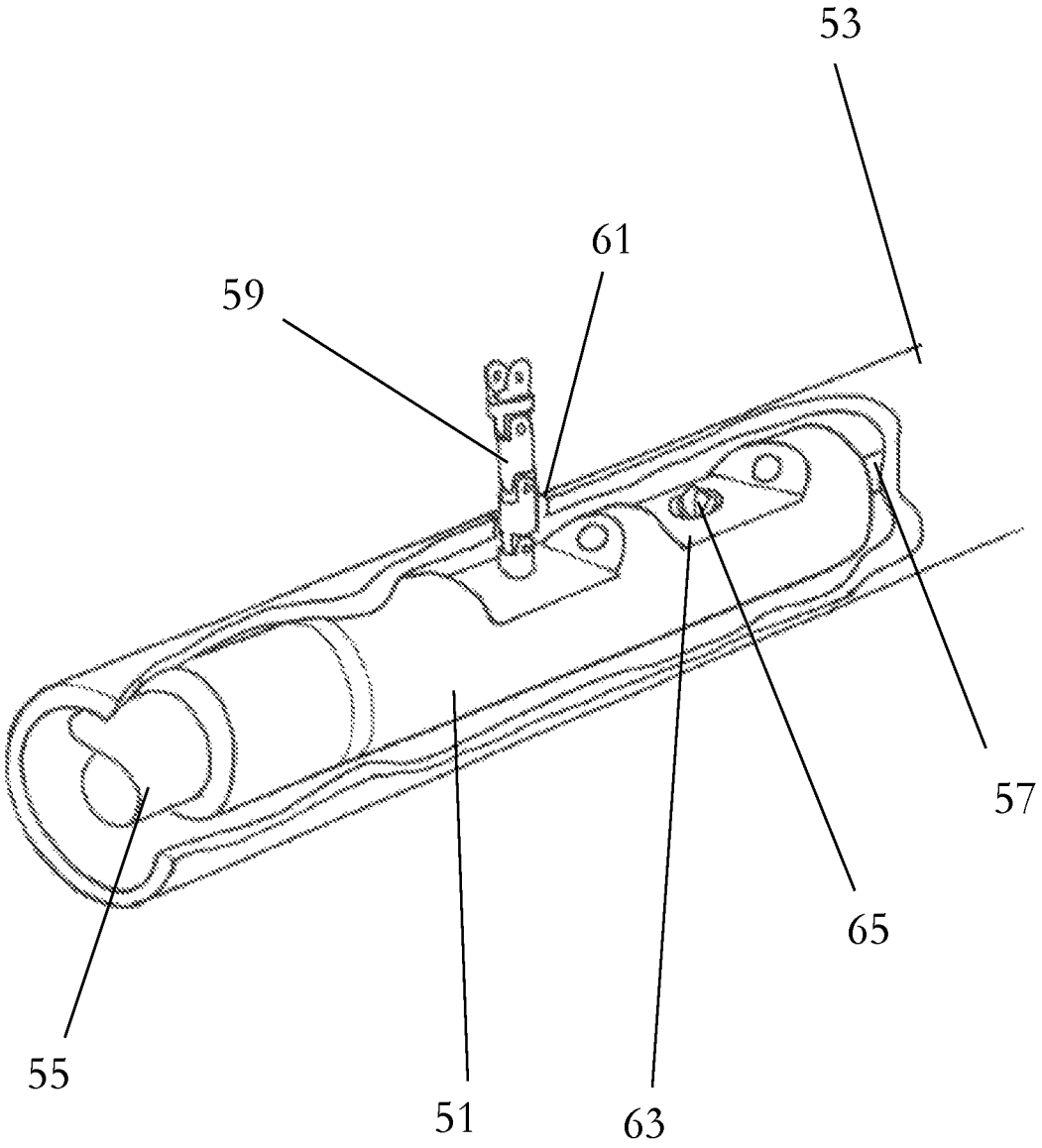
FIG. 4 is a partially cutaway perspective view of a piece of deployment equipment located down-bore in a lining pipe.

FIG. 4 is a partially cutaway perspective view of a piece of deployment equipment 51 located down-bore in a lining pipe 53. The deployment equipment 51 has connections at an up-bore end 55 and a down-bore end 57, and comprises a jointed probe 59 for extending through a hole 61 in the pipe 53. The probe may comprise conventional material injection apparatus, or may be configured to deploy equipment outside the pipe 53.

The deployment equipment 51 also includes drilling equipment 63 as part thereof, and in particular has a retracted drill bit 65.

The deployment equipment 51 could be manoeuvred into position within the pipe 53 for the drill bit 65 to drill the hole 61, and then the deployment equipment 51 could be further moved to allow the probe 59 to be extended through the hole 61.

The invention claimed is:

1. A method of underground deployment, the method comprising the steps of:

drilling an underground bore through underlying geology;

lining the bore with a pipe;

passing equipment down the bore to a predetermined location;

using the equipment to make a hole at most only partially through the pipe at the predetermined location;

passing deployment equipment down the pipe to the predetermined location;

extending a probe through the hole, the probe configured to punch through the remaining pipe at the predetermined location; and deploying material and/or equipment through the hole in the pipe into the underlying geology.

2. A system for carrying out the method of underground deployment according to claim 1, the system comprising:

directional drilling apparatus for drilling an underground bore through underlying geology;

a pipe for lining the bore drilled by the directional drilling apparatus;

pipe lining equipment for lining the bore with the pipe;

equipment configured to pass down the pipe to a predetermined location, and configured to make a hole at most only partially through the pipe at the predetermined location; and deployment equipment configured to pass down the pipe to a predetermined location, and a probe configured to extend through the hole and punch through the remaining pipe at the predetermined location, and configured to deploy material and/or equipment through a hole in the pipe into the underlying geology.

* * * * *